US007380846B1

(12) United States Patent
Moreno

(10) Patent No.: US 7,380,846 B1
(45) Date of Patent: Jun. 3, 2008

(54) BAR SEAL FOR CONTAINER

(76) Inventor: Jose M. Moreno, 2770 NW. 87 Ter., Pembroke Pines, FL (US) 33024

( * ) Notice: Subject to any disclaimer, the term of this patent is extended or adjusted under 35 U.S.C. 154(b) by 223 days.

(21) Appl. No.: 11/428,777

(22) Filed: Jul. 5, 2006

(51) Int. Cl.
*E05C 19/00* (2006.01)

(52) U.S. Cl. ..... 292/259 R; 340/572.9; 70/14; 292/282; 248/515

(58) Field of Classification Search ..... 292/259 R, 292/282; 340/572.9; 70/14; 248/515, 499
See application file for complete search history.

(56) References Cited

U.S. PATENT DOCUMENTS 4,812,823 A * 3/1989 Dickerson ..... 340/573.4
5,120,097 A * 6/1992 Fattori et al. ..... 292/318
5,284,036 A * 2/1994 Rosenbaum ..... 70/14
6,256,973 B1 * 7/2001 Langen ..... 57/281
7,044,512 B1 * 5/2006 Moreno ..... 292/259 R

* cited by examiner

*Primary Examiner*—Amy J. Sterling
(74) *Attorney, Agent, or Firm*—Albert Bordas, P.A.

(57) ABSTRACT

A single-use security bar seal assembly for containers, comprising an elongated bar member having first and second ends, a support assembly, and a receiving bracket. The receiving bracket, support assembly, and bar member have transparent plastic covers. The single-use security bar seal assembly has bar-codes on all individual parts and electrical means for determining severance of the elongated bar member.

20 Claims, 11 Drawing Sheets

BAR SEAL FOR CONTAINER

BACKGROUND OF THE INVENTION

1. Field of the Invention

The present invention relates to security systems and more particularly, to security bar seals for containers.

2. Description of the Related Art

Millions of shipping containers flow through ports all over the world on a daily basis. It is imperative to keep the contents of those shipping containers secure and not have them compromised. In addition to theft of contents, there is a need to ensure that shipping containers are not used as vehicles to transport illegal narcotics, illegal weapons, and otherwise unauthorized matter.

Several bar seals have been developed in the past. However, Applicant believes that the closest reference corresponds to Applicant's own U.S. Pat. No. 7,044,512, issued on May 16, 2006 for Bar seal for shipping container. However, it differs from the present invention because the present invention includes non-obvious innovation detailed in the following specification, including a single-use security bar seal system having transparent plastic covers integrally mounted thereon and identification matching codes on all individual parts and electrical means for determining severance of a bar assembly.

SUMMARY OF THE INVENTION

A security bar seal assembly for containers, comprising an elongated bar member having first and second ends. The first end has a protrusion. The elongated bar member has a first aperture of a predetermined depth between the first and second ends and at least one through hole in between the first aperture and the second end. Electrical means detect severance of the elongated bar member. The elongated bar member further has a first transparent cover. A support assembly has a first U-shaped member. The first U-shaped member has first and second slots to receive the second end therethrough. The support assembly has a second transparent cover. A receiving bracket has a second U-shaped member connected to a housing. The second U-shaped member has third and fourth slots to receive the second end. The housing comprises locking means to lock the elongated bar member to the support assembly and the receiving bracket. The receiving bracket has a third transparent cover.

The locking means comprises the receiving bracket having a second aperture with a snap ring to receive a locking pin. The locking pin has at least one groove to receive the snap ring when the locking pin is aligned with the at least one through hole and presented into the second aperture with sufficient force to overcome the snap ring.

The first, second, and third transparent covers provide visual evidence of tampering or disturbance to the elongated bar member, the support assembly, and/or the receiving bracket. The elongated bar member, the support assembly, and the receiving bracket each have labels thereon. The labels have matching identification codes thereon and are underneath the first, second, and third transparent cover. The labels are visible through the first, second, and third transparent cover. The labels have bar-code and random secret codes in order to make it difficult for an unauthorized person to duplicate them during tampering or theft of contents within a container. The labels have specific descriptions and/or instructions that may include characteristics of and how to operate, how to lock, and how to unlock the receiving bracket, the support assembly, and the bar member; that the receiving bracket, the support assembly, and the bar member are weldless and paintless; and description of the transparent plastic covers, matching identification codes, and bar-code and random secret codes. The bar-code and random secret codes comprises at least one number, word, and/or symbol that may be stamped on the labels.

The electrical means comprises the elongated bar member capable of an uninterrupted succession or flow of electrical current. The first aperture and the locking pin are tested with a continuity testing assembly to detect if the elongated bar member has been severed. The continuity testing assembly comprises a wand and an insert connected to one another by a wire. The continuity testing assembly is used to detect if the elongated bar member has been severed. The continuity testing assembly comprises a light emitting or sound producing alarm for negative electrical continuity and/or light emitting or sound producing alarm for positive electrical continuity.

The first and second U-shaped members snugly fit around door bars of the container, and in the preferred embodiment, the container is a shipping container. The elongated bar member, the support assembly, and the receiving bracket are for a single-use. The adhesive door label is placed upon a slit in between doors of the shipping container. The door label is tamper proof in the sense that it will not peel off the doors in the event the doors are opened or removed, but will tear instead. The door label comprises bar-code and random secret codes that comprise at least one number, word, and/or symbol that matches the receiving bracket, the support assembly, and the bar member.

The elongated bar member, the support assembly, the receiving bracket, and the locking pin are made of hardened steel or other metallic material having similar tough and durable characteristics in order to make it difficult for an unauthorized person to remove them by cutting, sawing, torching, grinding, or otherwise tampering with.

More specifically, the instant invention is a security bar seal assembly for shipping containers, comprising an elongated bar member having first and second ends. The first end has a protrusion. The elongated bar member has a first aperture of a predetermined depth between the first and second ends and at least one through hole in between the first aperture and the second end. Electrical means are used for detecting severance of the elongated bar member. The elongated bar member further has a first transparent cover. A support assembly has a first U-shaped member. The first U-shaped member has first and second slots to receive the second end therethrough. The support assembly has a second transparent cover. A receiving bracket has a second U-shaped member connected to a housing. The second U-shaped member has third and fourth slots to receive the second end. The housing comprises locking means to lock the elongated bar member to the support assembly and the receiving bracket. The receiving bracket having a third transparent cover.

The locking means comprises the receiving bracket having a second aperture with a snap ring to receive a locking pin. The locking pin has at least one groove to receive the snap ring when the locking pin is aligned with the at least one through hole and presented into the second aperture with sufficient force to overcome the snap ring.

The first, second, and third transparent covers provide visual evidence of tampering or disturbance to the elongated bar member, the support assembly, and/or the receiving bracket. The elongated bar member, the support assembly, and the receiving bracket each have labels thereon. The labels have matching identification codes thereon and are visible through the first, second, and third transparent covers. The labels further have bar-code and random secret codes in order to make it difficult for an unauthorized person to duplicate them during tampering or theft of contents within a container. The bar-code and random secret codes comprises at least one number, word, and/or symbol that may be stamped on the labels. Electrical means comprise the elongated bar member capable of an uninterrupted succession or flow of electrical current. The first aperture and the locking pin are tested with a continuity testing assembly to detect if the elongated bar member has been severed. The continuity testing assembly comprises a wand and an insert connected to one another by a wire. The continuity testing assembly used to detect if the elongated bar member has been severed. The continuity testing assembly comprises a light emitting or sound producing alarm for negative electrical continuity and/or light emitting or sound producing alarm for positive electrical continuity. The first and second U-shaped members snugly fit around door bars of the container that can be a shipping container. The elongated bar member, the support assembly, and the receiving bracket are for a single-use, and further comprise an adhesive door label placed upon a slit in between doors of the shipping container.

It is therefore one of the main objects of the present invention to provide a bar seal for containers that is effective against tampering.

It is another object of this invention to provide a bar seal for containers that is durable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
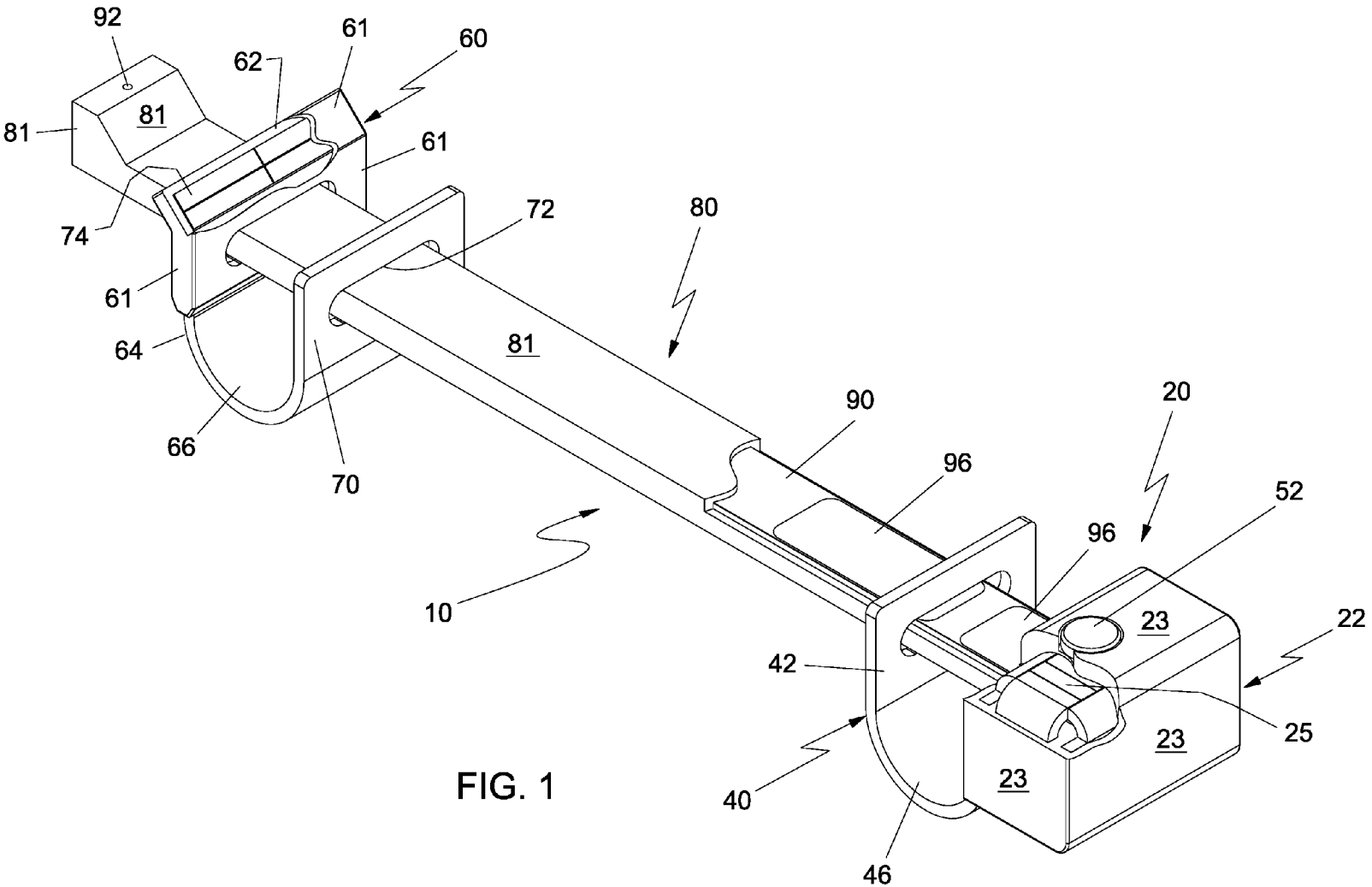
FIG. 1 represents a perspective view of the instant invention, with illustration of its transparent plastic covers partially cross-sectioned.

Referring now to the drawings, where the present invention is generally referred to with numeral 10, it can be observed that it basically includes receiving bracket 20, support assembly 60, and bar member 80.

As seen in FIG. 1, the instant invention comprises receiving bracket 20 and support assembly 60 locking bar member 80, whereby receiving bracket 20 and support assembly 60 have slots of cooperative characteristics to receive bar member 80 therethrough. Receiving bracket 20, support assembly 60, and bar member 80 have transparent plastic covers 23, 61, and 81 respectively.

Receiving bracket 20, support assembly 60, and bar member 80 also have matching codes, wherein each of the components have matching identification codes. The matching identification codes may be stamped onto labels 25, 74, and 96 of receiving bracket 20, support assembly 60, and bar member 80 respectively. It is noted that transparent plastic covers 23, 61, and 81 cover each of labels 25, 74, and 96. A receiver may inspect each of receiving bracket 20, support assembly 60, and bar member 80 to ensure that they do in fact have the matching identification codes. In the event the receiver determines that the matching identification codes do not match, the receiver is on notice that the contents of the container 150, seen in FIG. 6, may have been disturbed or otherwise tampered with.

Furthermore, in addition to the matching identification codes, instant invention 10 may comprise bar-code and random secret codes made up of number(s), word(s), and/or any symbol that may be stamped on labels 25, 74, and 96. The random secret codes are stamped on any of labels 25, 74, and 96 and are known only by the sender and receiver in the preferred embodiment. Before severing bar member 80 to open the container 150, the receiver, knowing the bar-code and random secret codes, can determine if any of receiving bracket 20, support assembly 60, and/or bar member 80 were replaced after being sent by the sender. In the event the receiver determines that the bar-code and random secret codes do not match those originating from the sender, the receiver is on notice that the contents of the container 150 may have been disturbed or otherwise tampered with. Bar-codes, and/or universal product codes, are used in the preferred embodiment in order to make it difficult for an unauthorized person to duplicate them during tampering or theft of contents within container 150, seen in FIG. 6.

In addition, specific descriptions and/or instructions may be placed onto labels 96. Such descriptions and/or instructions may include, but are not limited to, characteristics of and how to operate, how to lock, and how to unlock receiving bracket 20, support assembly 60, and bar member 80. Other descriptions and/or instructions may include, but are not limited to, indicating that receiving bracket 20, support assembly 60, and bar member 80 are weldless and paintless, and description of transparent plastic covers 23, 61, and 81. Yet other descriptions and/or instructions may include, but are not limited to, describing all matching identification codes and/or bar-code and random secret codes.

Transparent plastic covers 23, 61, and 81 are made of a transparent plastic material that allows a person to see the matching identification codes and/or bar-code and random secret codes defined above. In the preferred embodiment, a bar-code scanner may be utilized to read the bar-code. Transparent plastic covers 23, 61, and 81 serve to provide visual evidence of tampering or disturbance to receiving bracket 20, support assembly 60, and/or bar member 80. If receiving bracket 20, support assembly 60, and/or bar member 80 is cut, sawed, torched, grinded, or otherwise tampered with, the receiver is on notice that the contents of the container 150, seen in FIG. 6, may have been disturbed or otherwise tampered with.

Figure 2A:
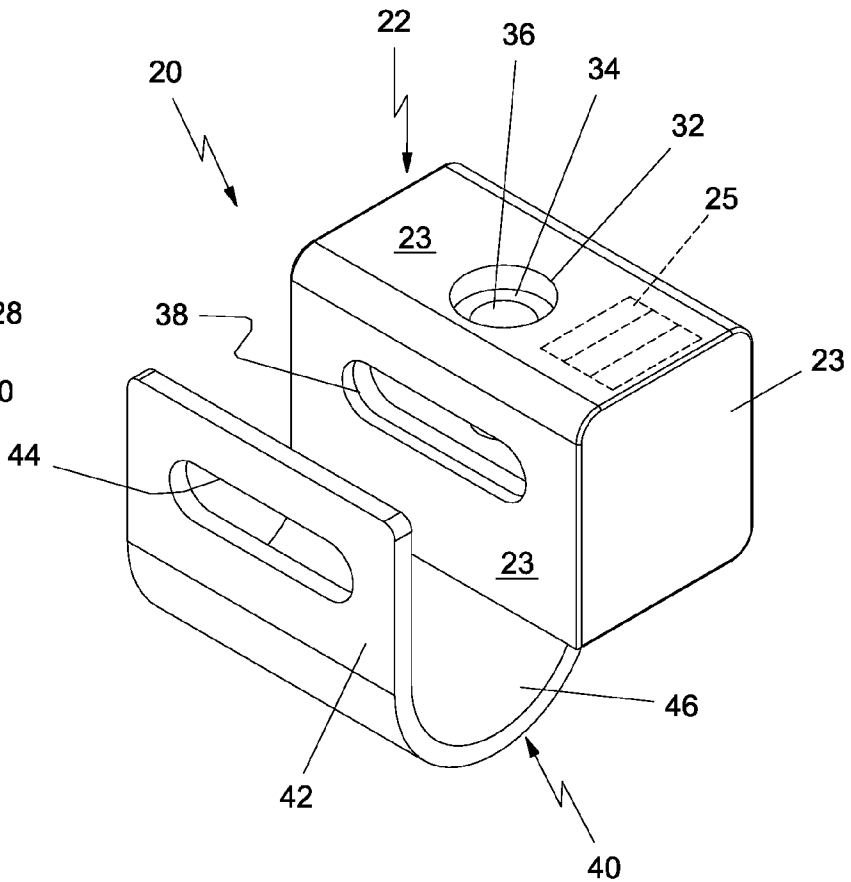
FIG. 2A shows a perspective view of the receiving bracket seen in FIG. 2 with its respective transparent plastic cover.
Figure 2:
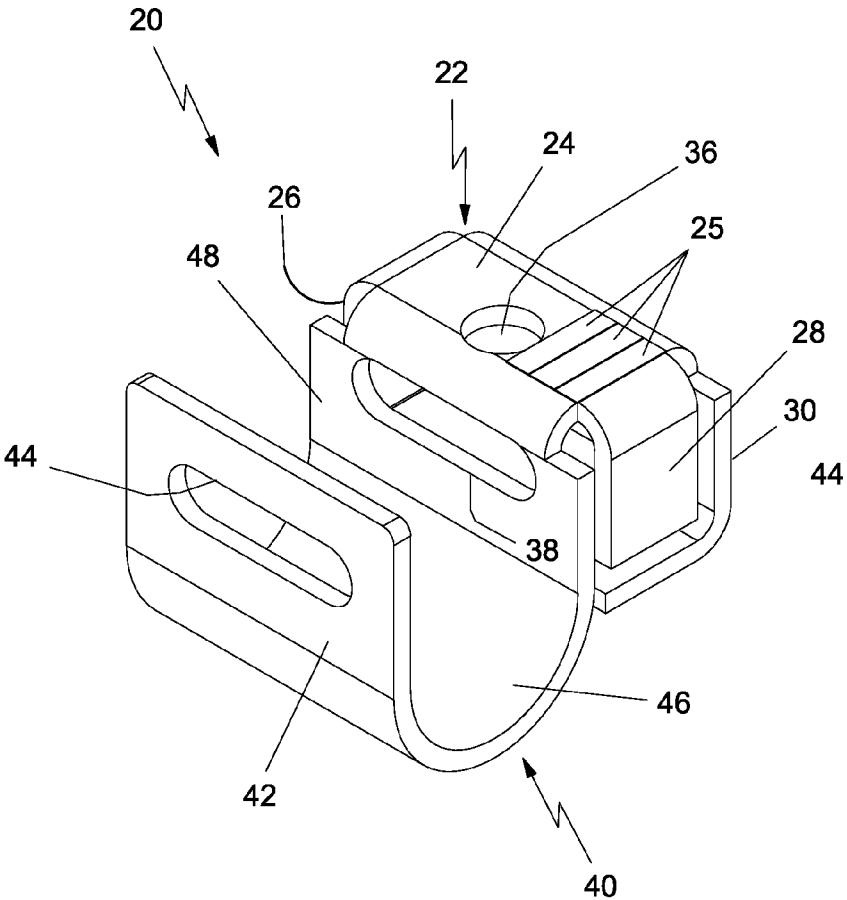
FIG. 2 shows a perspective view of the receiving bracket without its respective transparent plastic cover.

As seen in FIGS. 2 and 2A, receiving bracket 20 comprises receiving assembly 22 and support 40. Receiving assembly 22 comprises wall 24 having aperture 32 to receive pin 50. Within aperture 32 is face 34, and aperture 36 of a smaller diameter than aperture 32 to receive shank 54, seen in FIG. 3. Perpendicularly from face 24 are walls 26, 28, and 30, which form receiving assembly 22. Support 40 is connected to receiving assembly 22. Support 40 comprises walls 42 and 48 parallel and equally spaced apart from each other by curved wall 46. Walls 42 and 48 have slots 44 and 38 respectively, of cooperative characteristics to receive bar member 80 therethrough.

As best seen in FIG. 2A receiving bracket 20 comprises transparent plastic cover 23. Transparent plastic cover 23 covers receiving assembly 22 and wall 48 of support 40. As illustrated in this embodiment, label 25 is visible through transparent plastic cover 23.

Figure 3A:
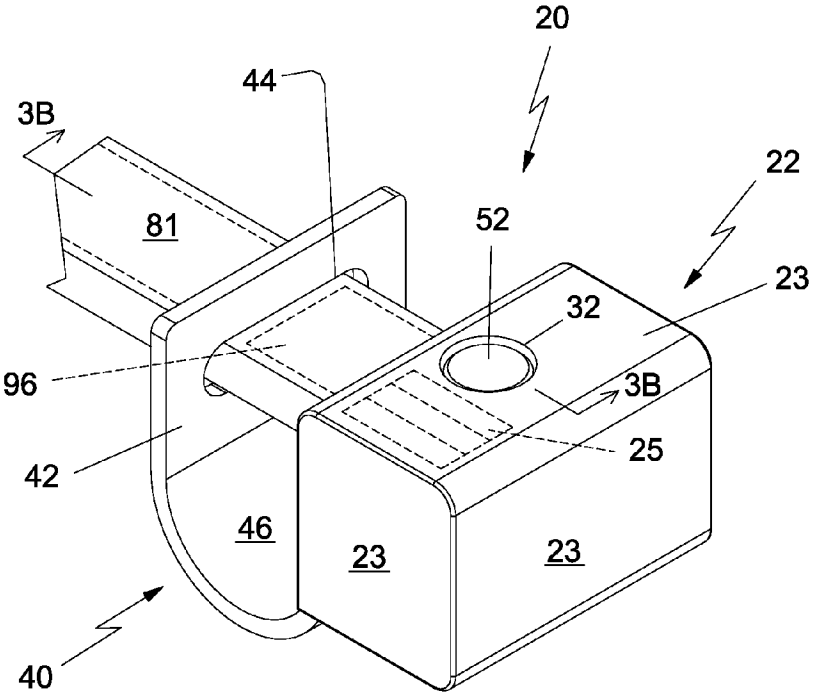
FIG. 3A shows a perspective view of the receiving bracket seen in FIG. 2A with the bar member locked with the pin.
Figure 3:
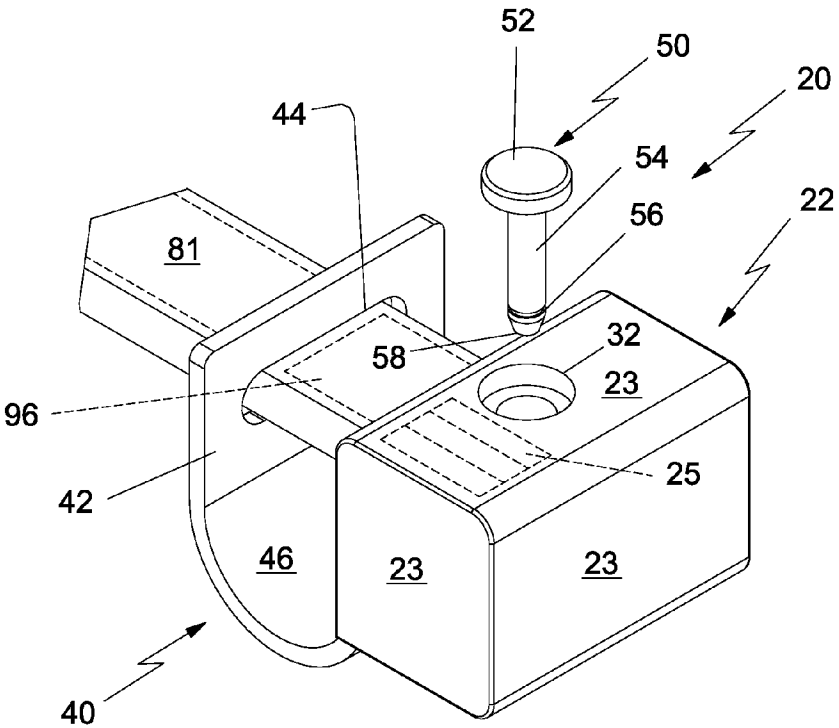
FIG. 3 shows a perspective view of the receiving bracket seen in FIG. 2A with the bar member in position to be locked with the pin.

As seen in FIG. 3, bar member 80 has been secured through slots 44 and 38. Pin 50 comprises head 52. Extending from head 52 is shank 54 having groove 56 and terminating at end 58.

FIG. 3A shows bar member 80 secured through slots 44 and 38, and locked by pin 50 having head 52.

Figure 3B:
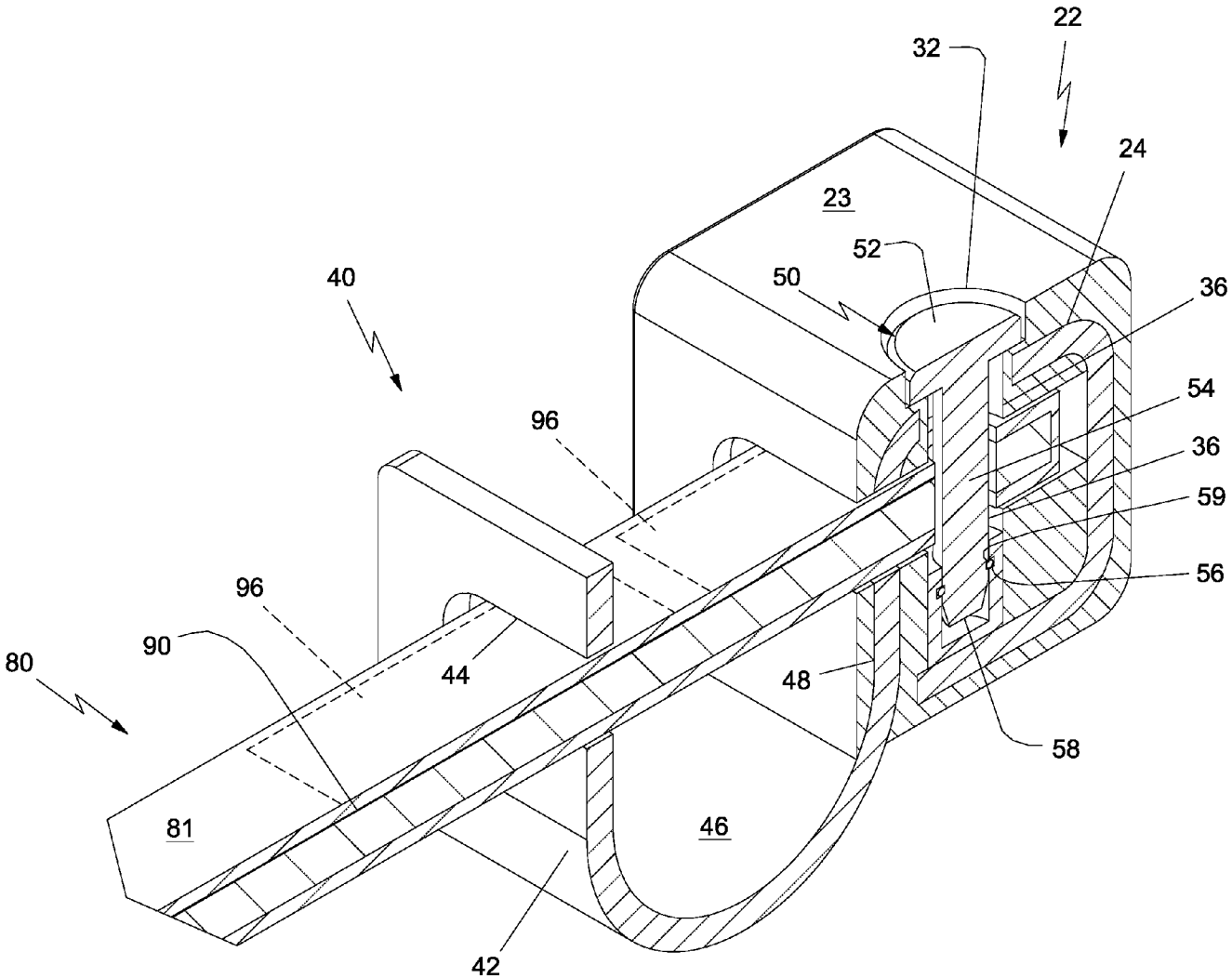
FIG. 3B is a cut view of the receiving bracket locking the bar member with the pin taken along the lines 3B-3B, as seen in FIG. 3A.

As seen in FIG. 3B, pin 50 has been snapped into position within aperture 32, thus locking bar member 80. Ring 59, within aperture 36, snaps and locks around groove 56 of shank 54.

Figure 4:
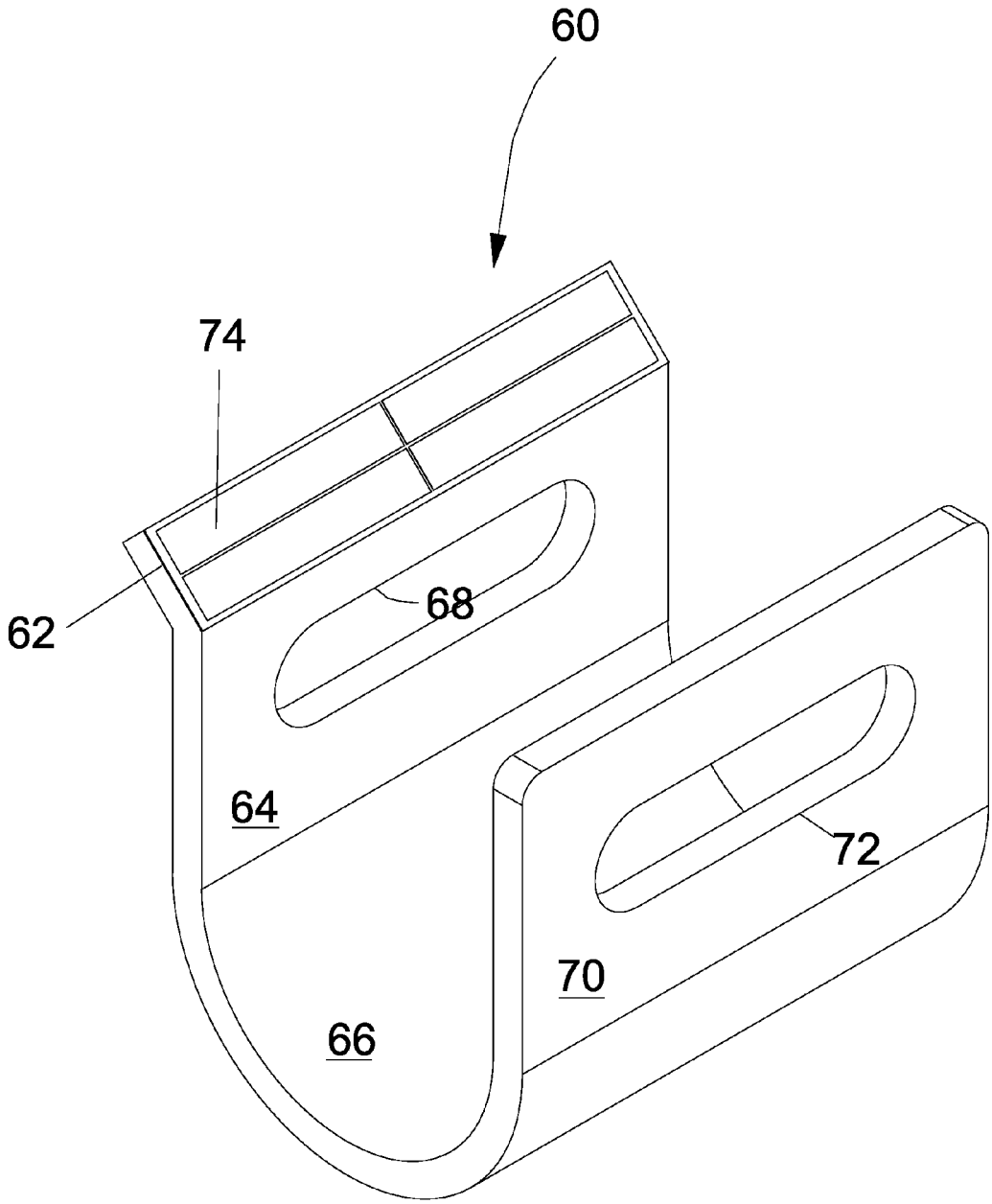
FIG. 4 shows a perspective view of the support assembly without its respective transparent plastic cover.

As seen in FIG. 4, support assembly 60 comprises walls 64 and 70 parallel and equally spaced apart from each other by curved wall 66. Walls 64 and 70 have slots 68 and 72 respectively of cooperative characteristics to receive bar member 80 therethrough. Extending at a predetermined angle from wall 64 is lip 62. Slots 68 and 72 receive bar member 80 for support.

Figure 4A:
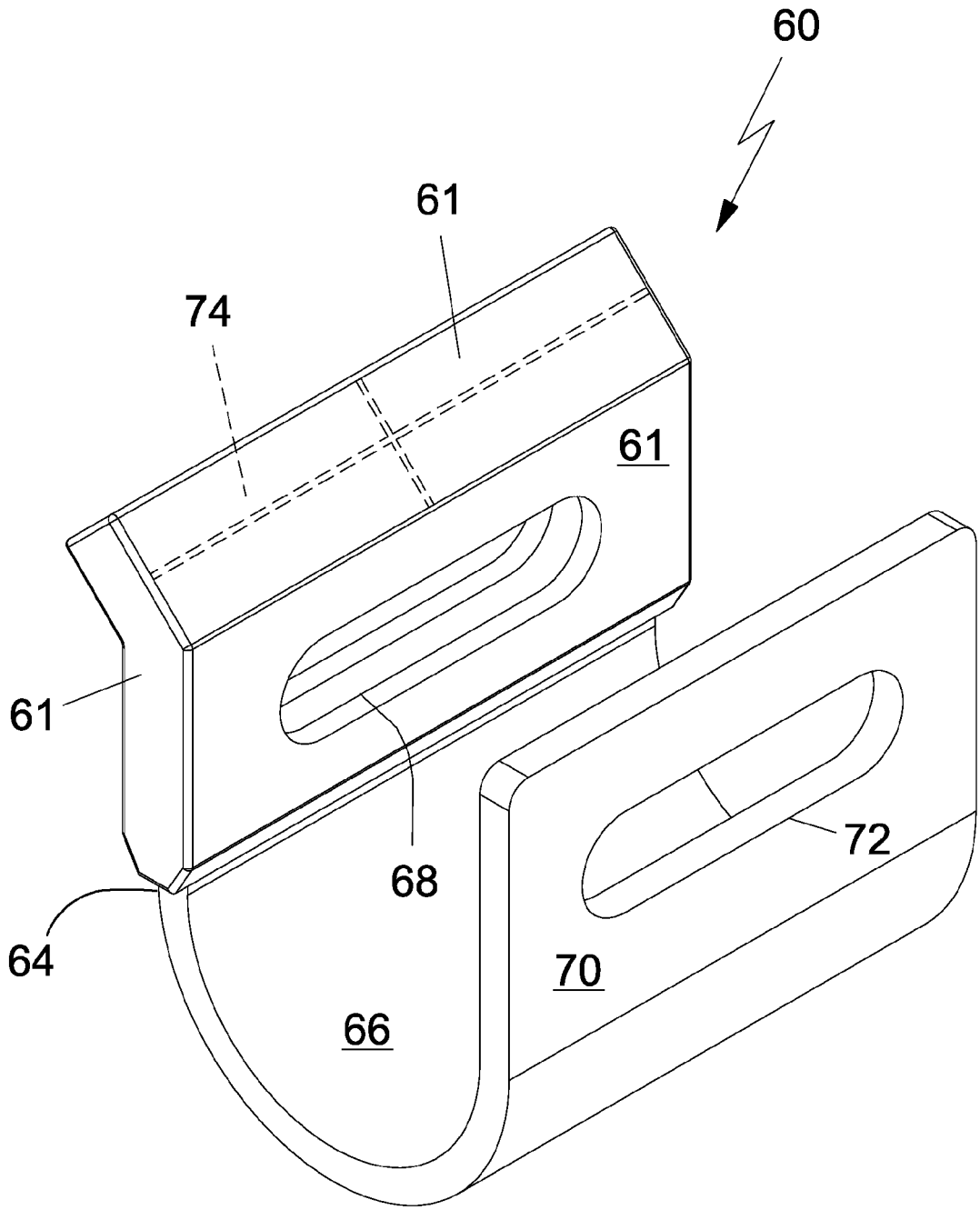
FIG. 4A shows a perspective view of the support assembly seen in FIG. 4 with its respective transparent plastic cover.

As best seen in FIG. 4A support assembly 60 comprises transparent plastic cover 61. Transparent plastic cover 61 covers most of wall 64 and lip 62 entirely. As illustrated in this embodiment, label 74 is visible through transparent plastic cover 61.

Figure 5:
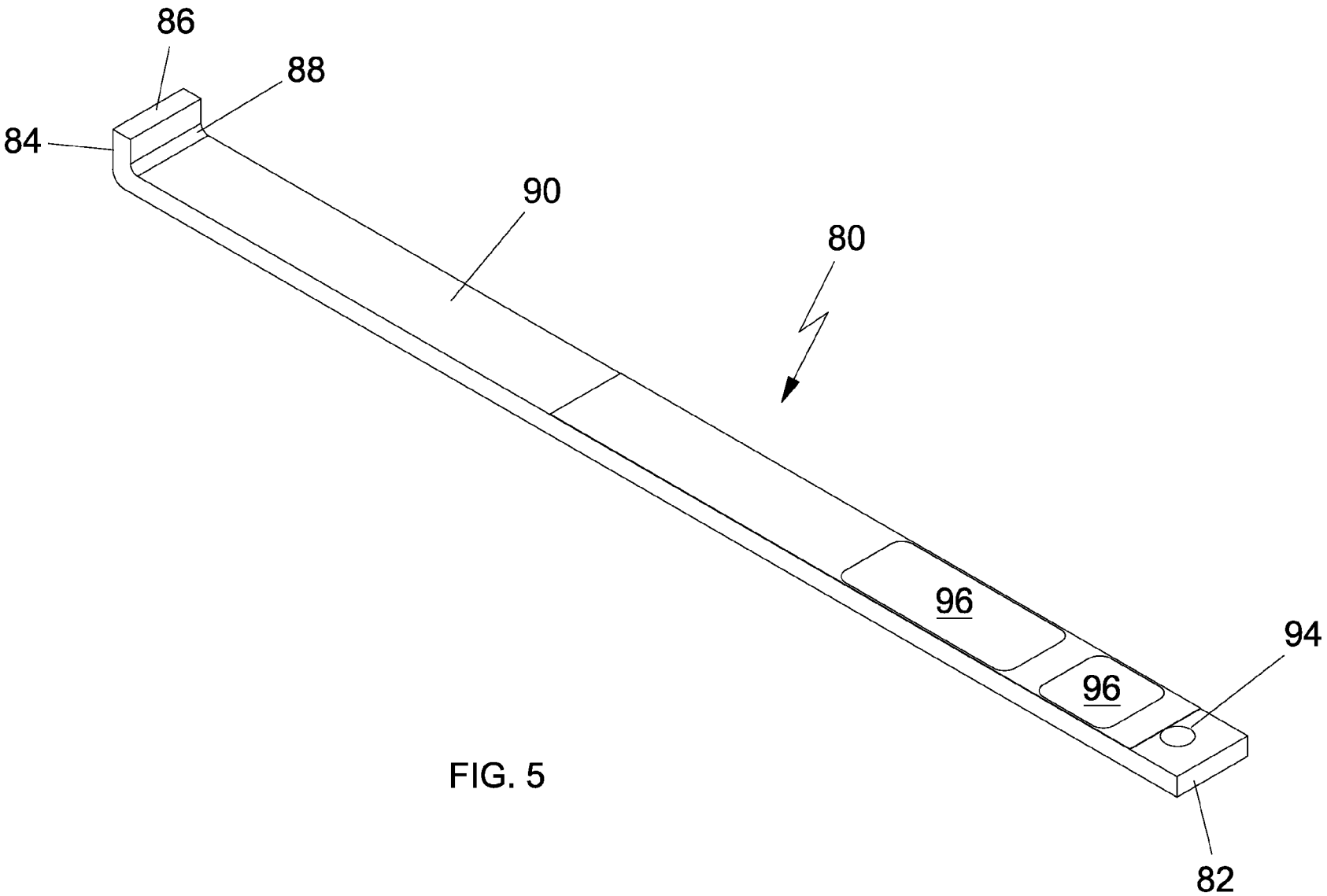
FIG. 5 illustrates a perspective view of the bar member without its respective transparent plastic cover.

As seen in FIG. 5, bar member 80 comprises elongated member 90 having ends 82 and 84. Extending from end 84 is wall 86 of a predetermined length. Extending at a predetermined angle from wall 86 is wall 88. It is noted that walls 86 and 88 are shaped to lock end 84 with support assembly 60.

Figure 5A:
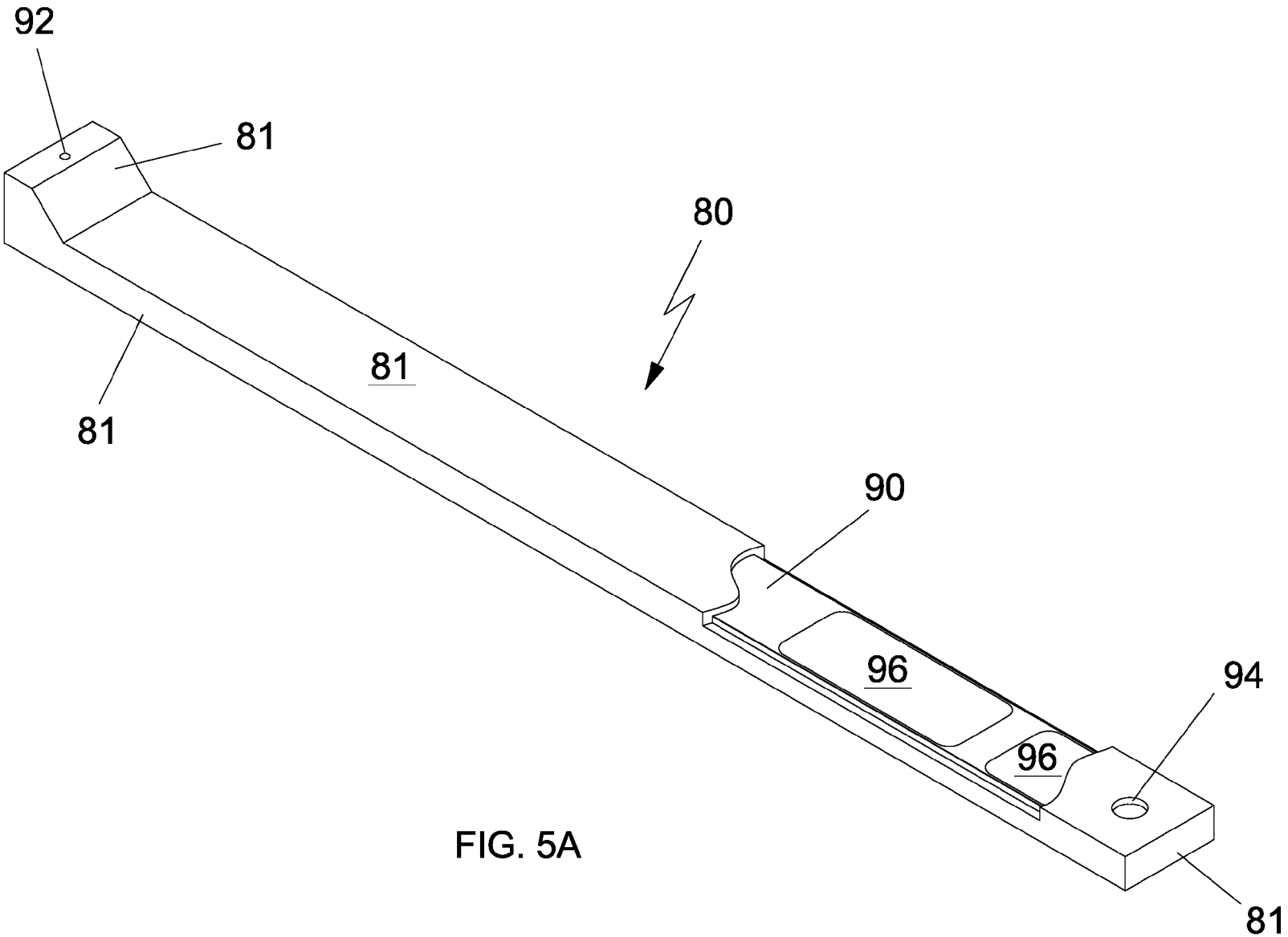
FIG. 5A illustrates a perspective view of the bar member with its respective transparent plastic cover partially cross-sectioned.

As best seen in FIG. 5A, bar member 80 comprises transparent plastic cover 81. Transparent plastic cover 81 covers bar member 80. Labels 96 are visible through transparent plastic cover 81. Elongated member 90 also comprises contact point 92 and aperture 94 through transparent plastic cover 81.

Bar member 80 is metallic from ends 82 to 84. Electrical means, seen in FIG. 6B, are used for determining severance of bar member 80. More specifically, electrical continuity testing may be conducted to ensure bar member 80 has not been severed.

Figure 6:
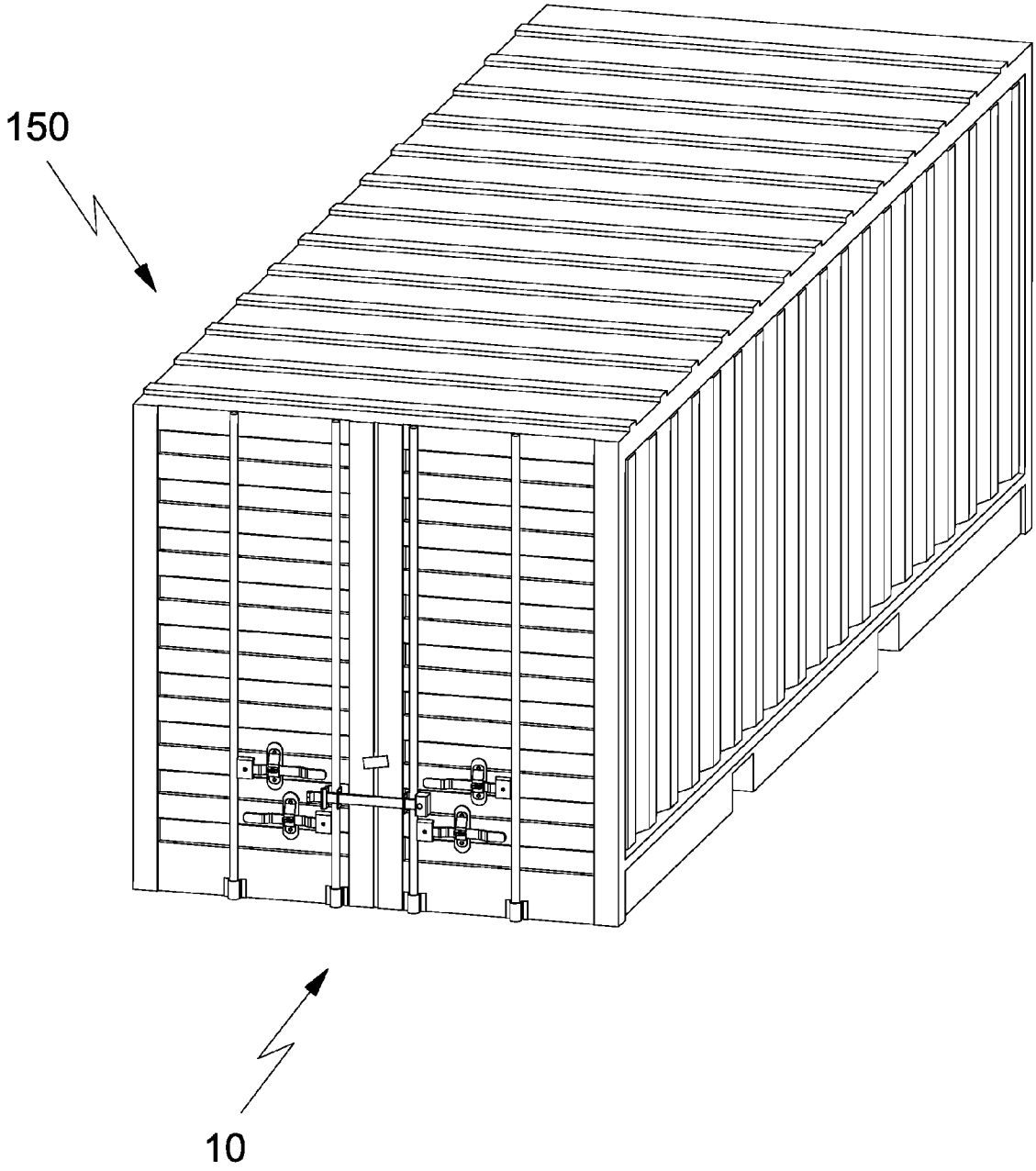
FIG. 6 represents a perspective view of the instant invention mounted onto a container.
Figure 6A:
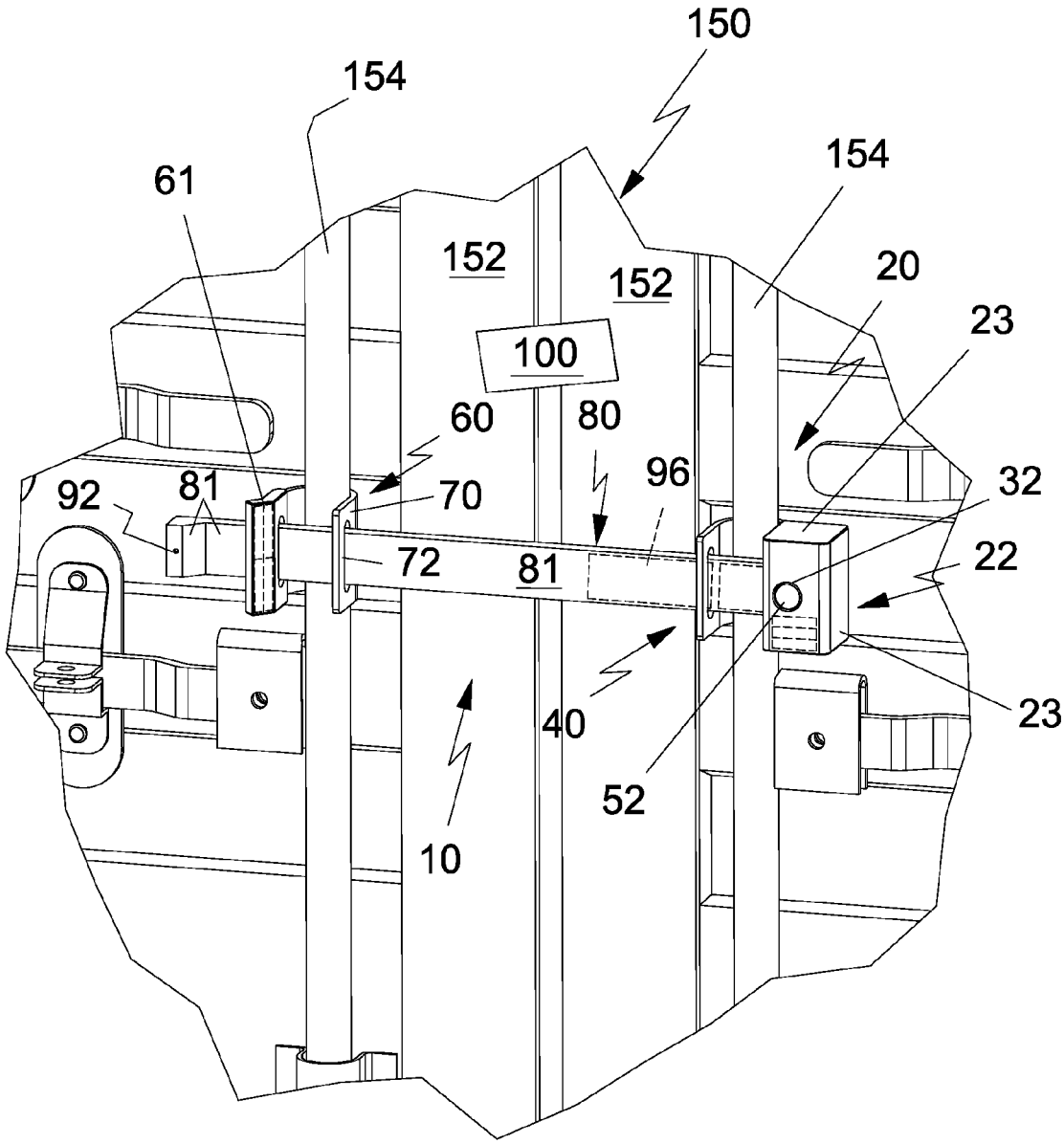
FIG. 6A represents a close-up perspective view of the instant invention mounted onto the container bars.
Figure 6B:
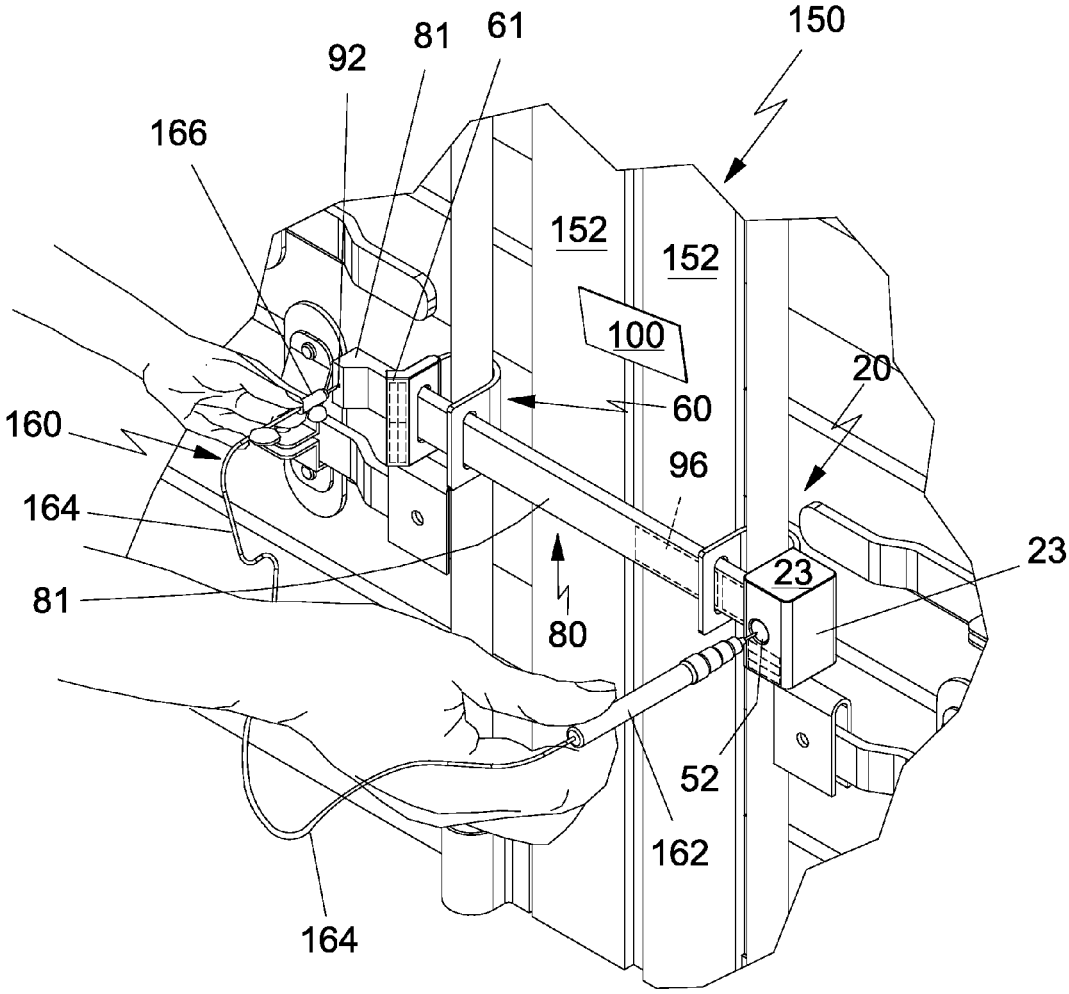
FIG. 6B represents a perspective view of the instant invention mounted on container bars and being tested for severance of the bar member.

As seen in FIGS. 6 and 6A, instant invention 10 may be mounted upon a standard container 150 having doors 152 with bars 154. As seen in the present illustration, curved walls 46 and 66 of receiving bracket 20 and support assembly 60 respectively snugly fit around bars 154. Other embodiments of the present invention may include curved walls 46 and 66 of different sizes to accommodate various bar 154 circumferences of doors 152. Instant invention 10 may also comprise label 100. Label 100 is defined as a tamper proof label having an adhesive back that is intended for a one-time use. Label 100 has bar-codes, and/or universal product codes, as described above in order to make it difficult for an unauthorized person to duplicate them during tampering or theft of contents within container 150. In the preferred embodiment, label 100 is placed directly over the slit between doors 152. That way label 100 will rip, or otherwise tear, if one or both of doors 152 are opened or removed. Label 100 comprises the same matching identification codes and/or bar-code and random secret codes on labels 25, 74, and 96.

As seen in FIG. 6B, continuity testing assembly 160 comprises wand 162 and insert 166 connected to one another by wire 164. With continuity testing assembly 160, a person may determine if bar member 80 has been severed. More specifically, electrical continuity testing is performed by inserting insert 166 into contact point 92 while inserting the tip of wand 162 onto head 52 of pin 50 to detect if bar member 80 has been severed. Continuity testing assembly 160 may include a light emitting or sound producing alarm for negative electrical continuity and/or light emitting or sound producing alarm for positive electrical continuity.

In the preferred embodiment, receiving bracket 20, support assembly 60, and bar member 80 are made of hardened steel or other metallic material having similar tough and durable characteristics in order to make it difficult for an unauthorized person to remove instant invention 10 from container 150 by cutting, sawing, torching, grinding, or otherwise tampering with.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security bar seal assembly for containers, comprising:

A) an elongated bar member having first and second ends, the first end having a protrusion, the elongated bar member has a first aperture of a predetermined depth between the first and second ends and at least one through hole in between the first aperture and the second end and electrical means for detecting severance of the elongated bar member, said elongated bar member further having a first transparent cover;

B) a support assembly having a first U-shaped member, the first U-shaped member having first and second slots to receive the second end therethrough, said support assembly having a second transparent cover; and C) a receiving bracket having a second U-shaped member connected to a housing, the second U-shaped member having third and fourth slots to receive the second end, the housing comprising locking means to lock the elongated bar member to the support assembly and the receiving bracket, said receiving bracket having a third transparent cover.

2. The security bar seal assembly for containers set forth in claim 1, further characterized in that the locking means comprises the receiving bracket having a second aperture with a snap ring to receive a locking pin, the locking pin having at least one groove to receive the snap ring when the locking pin is aligned with the at least one through hole and presented into the second aperture with sufficient force to overcome the snap ring.

3. The security bar seal assembly for containers set forth in claim 2, further characterized in that the first, second, and third transparent covers provide visual evidence of tampering or disturbance to said elongated bar member, said support assembly, and/or said receiving bracket.

4. The security bar seal assembly for containers set forth in claim 2, further characterized in that the elongated bar member, the support assembly, and the receiving bracket each have labels thereon.

5. The security bar seal assembly for containers set forth in claim 4, further characterized in that the labels have matching identification codes thereon and underneath said first, second, and third transparent cover.

6. The security bar seal assembly for containers set forth in claim 4, further characterized in that the labels are visible through said first, second, and third transparent cover.

7. The security bar seal assembly for containers set forth in claim 4, further characterized in that the labels have bar-code and random secret codes in order to make it difficult for an unauthorized person to duplicate them during tampering or theft of contents within a container.

8. The security bar seal assembly for containers set forth in claim 4, further characterized in that the labels have specific descriptions and/or instructions that may include characteristics of and how to operate, how to lock, and how to unlock said receiving bracket, said support assembly, and said bar member, that said receiving bracket, said support assembly, and said bar member are weldless and paintless, and description of said transparent plastic covers, matching identification codes, and bar-code and random secret codes.

9. The security bar seal assembly for containers set forth in claim 8, further characterized in that the bar-code and random secret codes comprises at least one number, word, and/or symbol that may be stamped on said labels.

10. The security bar seal assembly for containers set forth in claim 2, further characterized in that the electrical means comprises the elongated bar member capable of an uninterrupted succession or flow of electrical current, the first aperture and said locking pin tested with a continuity testing assembly to detect if the elongated bar member has been severed.

11. The security bar seal assembly for containers set forth in claim 10, further characterized in that the continuity testing assembly comprises a wand and an insert connected to one another by a wire, the continuity testing assembly used to detect if the elongated bar member has been severed.

12. The security bar seal assembly for containers set forth in claim 11, further characterized in that the continuity testing assembly comprises a light emitting or sound producing alarm for negative electrical continuity and/or light emitting or sound producing alarm for positive electrical continuity.

13. The security bar seal assembly for containers set forth in claim 2, further characterized in that the first and second U-shaped members snugly fit around door bars of said container.

14. The security bar seal assembly for containers set forth in claim 13, further characterized in that the container is a shipping container.

15. The security bar seal assembly for containers set forth in claim 14, further characterized in that said elongated bar member, the support assembly, and the receiving bracket are for a single-use.

16. The security bar seal assembly for containers set forth in claim 15, further comprising an adhesive door label placed upon a slit in between doors of the shipping container, said door label is tamper proof in the sense that it will not peel off the doors in the event said doors are opened or removed, but will tear instead, said door label comprises bar-code and random secret codes that comprise at least one number, word, and/or symbol that matches the receiving bracket, the support assembly, and the bar member.

17. The security bar seal assembly for containers set forth in claim 16, further characterized in that said elongated bar member, said support assembly, said receiving bracket, and said locking pin are made of hardened steel or other metallic material having similar tough and durable characteristics in order to make it difficult for an unauthorized person to remove them by cutting, sawing, torching, grinding, or otherwise tampering with.

18. A security bar seal assembly for shipping containers, comprising:

A) an elongated bar member having first and second ends, the first end having a protrusion, the elongated bar member has a first aperture of a predetermined depth between the first and second ends and at least one through hole in between the first aperture and the second end and electrical means for detecting severance of the elongated bar member, said elongated bar member further having a first transparent cover;

B) a support assembly having a first U-shaped member, the first U-shaped member having first and second slots to receive the second end therethrough, said support assembly having a second transparent cover; and C) a receiving bracket having a second U-shaped member connected to a housing, the second U-shaped member having third and fourth slots to receive the second end, the housing comprising locking means to lock the elongated bar member to the support assembly and the receiving bracket, said receiving bracket having a third transparent cover.

19. The security bar seal assembly for shipping containers set forth in claim 18, further characterized in that the locking means comprises the receiving bracket having a second aperture with a snap ring to receive a locking pin, the locking pin having at least one groove to receive the snap ring when the locking pin is aligned with the at least one through hole and presented into the second aperture with sufficient force to overcome the snap ring.

20. The security bar seal assembly for shipping containers set forth in claim 19, further characterized in that the first, second, and third transparent covers provide visual evidence of tampering or disturbance to said elongated bar member, said support assembly, and/or said receiving bracket, the elongated bar member, the support assembly, and the receiving bracket each have labels thereon, said labels have matching identification codes thereon and are visible through said first, second, and third transparent covers, said labels further have bar-code and random secret codes in order to make it difficult for an unauthorized person to duplicate them during tampering or theft of contents within a container, said bar-code and random secret codes comprises at least one number, word, and/or symbol that may be stamped on said labels, the electrical means comprises the elongated bar member capable of an uninterrupted succession or flow of electrical current, the first aperture and said locking pin tested with a continuity testing assembly to detect if the elongated bar member has been severed, said continuity testing assembly comprises a wand and an insert connected to one another by a wire, the continuity testing assembly used to detect if the elongated bar member has been severed, said continuity testing assembly comprises a light emitting or sound producing alarm for negative electrical continuity and/or light emitting or sound producing alarm for positive electrical continuity, the a first and second U-shaped members snugly fit around door bars of said container, the container is a shipping container, said elongated bar member, the support assembly, and the receiving bracket are for a single-use, and further comprising an adhesive door label placed upon a slit in between doors of said shipping container.

* * * * *